US006171169B1

(12) United States Patent
Saunders

(10) Patent No.: US 6,171,169 B1
(45) Date of Patent: Jan. 9, 2001

(54) ARTICULATED TOY FIGURE SIMULATING BASKETBALL PLAY

(75) Inventor: Jeff A. Saunders, Redondo Beach, CA (US)

(73) Assignee: Mattel, Inc., ElSegundo ( * ) Notice: Under 35 U.S.C. 154(b), the term of this patent shall be extended for 0 days.

(21) Appl. No.: 09/240,439

(22) Filed: Jan. 29, 1999

(51) Int. Cl.[7] ..... A63H 13/10

(52) U.S. Cl. ..... 446/308; 446/137; 446/139; 446/330; 446/378; 446/390

(58) Field of Search ..... 446/129, 137, 446/138, 139, 268, 308, 330, 354, 378, 390

(56) References Cited

U.S. PATENT DOCUMENTS

| | | | | |
|---|---|---|---|---|
| 1,551,050 | | 8/1925 | Parsons . | |
| 1,633,456 | | 6/1927 | Norberg . | |
| 2,903,264 | | 9/1959 | Munro et al. . | |
| 2,911,758 | * | 11/1959 | Carson | 446/308 |
| 3,074,720 | * | 1/1963 | Carver et al. . | |
| 3,425,153 | * | 2/1969 | Bonanno et al. | 446/308 |
| 3,566,537 | * | 3/1971 | Tepper et al. . | |
| 3,758,982 | | 9/1973 | Lemelson et al. . | |
| 3,862,513 | | 1/1975 | Isaacson et al. . | |
| 3,906,661 | | 9/1975 | Weiser . | |
| 3,911,616 | | 10/1975 | Pelfrey . | |
| 4,085,540 | * | 4/1978 | Jernstrom et al. . | |
| 4,186,518 | | 2/1980 | Luke . | |
| 4,605,381 | | 8/1986 | MacBain et al. . | |
| 4,623,318 | | 11/1986 | Tsiknopoulos et al. . | |
| 4,794,905 | * | 1/1989 | Woolard | 446/128 |
| 4,985,008 | | 1/1991 | Price . | |
| 5,087,219 | | 2/1992 | Price . | |
| 5,458,523 | | 10/1995 | Aoki et al. . | |
| 5,690,330 | * | 11/1997 | Ozawa | 446/354 |

* cited by examiner

*Primary Examiner*—Jacob K. Ackun
*Assistant Examiner*—Jeffrey D. Carlson
(74) *Attorney, Agent, or Firm*—Roy A. Ekstrand

(57) ABSTRACT

A toy figure torso supports at least one pivotal arm together with a spring-loaded mechanism urging the arm toward pivotal motion in a forward direction. A spring is coupled to the arm and provides the urging force. A trigger and latch mechanism is supported within the torso of the toy figure and is operable by a push button supported at the torso rear. The mechanism includes a cooperating lock arm and a cam which engage to inhibit return motion when the toy figure arm is raised to the cocked position. Energy is stored in the spring which is released by activation of the push button allowing rapid forwardly pivoting motion of the arm.

5 Claims, 4 Drawing Sheets

32
47
30
33
31
28
26
10
46
24
17
18
22
20
11
16
12
13
15

35
43
31
34
45
33
42
40
32
41

99
22
70
79
65
73
75
93
88
97
96
77
95
78
68
98
85
74
86
16
87
80
76
89
61
11
60
102
101
84
94
50
10

107
31
108
109
100
106
105

ARTICULATED TOY FIGURE SIMULATING BASKETBALL PLAY

FIELD OF THE INVENTION

This invention relates generally to articulated activity type toy figures and particularly to those employing a spring-loaded limb and trigger mechanism to execute various sport related actions.

BACKGROUND OF THE INVENTION

Toy figures, including dolls and such, are well known in the art and extremely popular among children of a broad age range. As a result, a virtually endless variety of toy figures have been provided which resemble human toy figures or dolls as well as toy figures which are fanciful or contrived in their appearance. Correspondingly, a great variety of toy figures have been provided which perform various human activities such as walking, talking, crawling, speaking and singing to name but a few.

One of the more popular types of action figures is found in a class of toys which may be generally described as sports action figures. Such toy figures typically attempt to perform various motions associated with a sport activity. Thus, toy figures have been provided which skate, swim, bowl, golf and execute a football kick. In most, the basic mechanism involved utilizes a spring-loaded limb and trigger release. In such toy figures, the user cocks the spring-loaded limb to a locking position and thereafter operates a trigger release allowing the spring-loaded limb to move abruptly through a range of motion which results in actions such as kicking a ball. For example, U.S. Pat. No. 1,633,456 issued to Norberg sets forth a FIGURE TOY having a toy figure wearing the clothing the equipment of a football player and having a spring-loaded pivotally secured leg. The player executes a rapid kicking motion against a ball to simulate a football punt. The figure's arms are also articulated and support the to-be-kicked ball. Means are provided for timing the dropping of the ball from the hands into the path of the swinging foot to execute the kick.

U.S. Pat. No. 3,911,616 issued to Pelfrey sets forth a TOY FIELD GOAL KICKER having a leg which supports a pivotal knee joint and pivotal foot to ankle joint. A spring-loaded mechanism is operative within the knee joint to urge the lower leg and foot to a forward position. A trigger latch secures the knee joint in a cocked position prior to kicking. Upon release, the lower leg and foot are driven forwardly and rapidly through the ball position resulting in a field goal type kick.

U.S. Pat. No. 3,862,513 issued to Isaacson, et al. sets forth a ARTICULATED FIGURE TOY having a torso rotatable at the waist about a vertical axis which is spring-biased toward a forward orientation. A spring-biased arm is rotatably mounted with respect to the torso to enable the arm and torso to be manually moved in one direction and then released to affect a quick full body movement in the opposite direction. Embodiments are shown for sport activities including golf, tennis, baseball and bowling.

U.S. Pat. No. 4,186,518 issued to Luke sets forth a KICKING DOLL WITH DETACHABLE TRIGGER MEANS having a toy figure resembling a soccer player supporting a pivotally secured spring-biased leg to form a kicking leg. A latch mechanism within the toy figure secures the leg in a drawn spring-loaded position. A separate and removable trigger apparatus is capable of engaging the toy figure and releasing the kicking action.

U.S. Pat. No. 2,903,264 issued to Munro, et al. sets forth a TABLE GAME WITH MAGNETIC PLAYING ELEMENT having a hockey game in which players are movable through a pivotal range of motion and inn which a playing element such as a hockey puck is formed to support a magnet therein.

U.S. Pat. No. 1,551,050 issued to Parsons sets forth a DOLL having magnets supported within the palm portion of the doll's hands. Various metal articles are capable being "held" by the doll due to their attraction to the palm magnets.

U.S. Pat. No. 5,087,219 issued to Price sets forth an ACTION CHARACTER FIGURE having a telescoping torso and lower body portion together with a spring-loaded arm mechanism.

U.S. Pat. No. 4,985,008 issued to Price sets forth a WRESTLER CHARACTER FIGURE having a pair of pivotally supported arms utilizing a spring pivot mechanism which facilitates the execution of a wrestler's throw of an opponent from above the head.

U.S. Pat. No. 4,623,318 issued to Tsiknopoulos, et al. sets forth a FIGURE WITH ROTATABLE TORSO AND VERTICALLY SWINGING ARMS having a pair of arms secured to the torso for relative movement with respect thereto in an upward direction about the shoulders when centrifugal force is applied to the torso.

U.S. Pat. No. 4,605,381 issued to MacBain, et al. sets forth an ANIMATED FIGURE TOY HAVING A UNITARY MULTIPLE FUNCTION SPRING supported within an upper torso of a toy figure and operatively coupled to a pivotally supported limb.

U.S. Pat. No. 3,758,982 issued to Lemelson, et al. sets forth an ACTIVITY DOLL having one or more pivotally mounted limbs arranged for movement from a normally retracted position at the figure's side to a front body or higher location. A spring-loaded trigger release mechanism allows the arms to be released against the spring mechanism to provide rapid movement thereof.

U.S. Pat. No. 3,906,661 issued to Weiser sets forth an ANIMATED TOY DOLL having a movable arm adapted to be moved automatically in a rapid downward chopping motion and a movable leg adapted to be moved automatically in a downward and upward kicking motion. A manual release is provided for executing limb movement.

U.S. Pat. No. 5,458,523 issued to Aoki, et al. sets forth an ACTION CHARACTER FIGURE ASSEMBLY having a pair of housings each defining an outer end with a manipulatable knob member supported thereon and a forward end supporting a toy figure. Apparatus is provided for causing the toy figure to respond to manipulation of the outer knob by the user to participate in a physical combat or the like.

While the foregoing described prior art devices have provided improvement in the art and have, in some instances, enjoyed commercial success, there remains nonetheless a continuing need in the art for evermore improved, interesting and exciting action toy figures.

SUMMARY OF THE INVENTION

Accordingly, it is a general object of the present invention to provide an improved articulated toy figure. It is a more particular object of the present invention to provide an improved articulated toy figure which simulates a novel sport activity. It is a still more particular object of the present invention to provide an improved articulated toy figure which is able to accurately and repeatedly execute the shooting operation of a basketball player.

In accordance with the present invention, there is provided a toy figure performing a basketball shot, the toy figure comprising: a torso defining an interior cavity; an arm pivotally secured to the torso to form a shoulder; a head supported by the arm having a first attraction element supported thereby; a spring-loaded arm mechanism supported within the interior cavity having a shaft rotatably supported by the torso and having one end joined to the arm and having a spring coupler and cam formed thereon together with a spring urging the arm toward a forwardly pivoting movement; a trigger latch mechanism supported within the interior cavity having a lock arm and arm pivot pivotally supported by the torso, the lock arm and the cam having a cooperating engagement members; a trigger button supported by the torso for exerting a force against the arm pivot which releases engagement of the lock arm and the cam allowing the spring to rapidly pivot the arm forwardly and downwardly; and a ball having a section attraction element supported thereby, the first and second attraction elements cooperating to releasibly maintain the ball against said hand, whereby the ball placed in the hand when the arm is cocked and released by the trigger button is shot forwardly and upwardly during the forwardly and downwardly pivotal motion of the arm.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
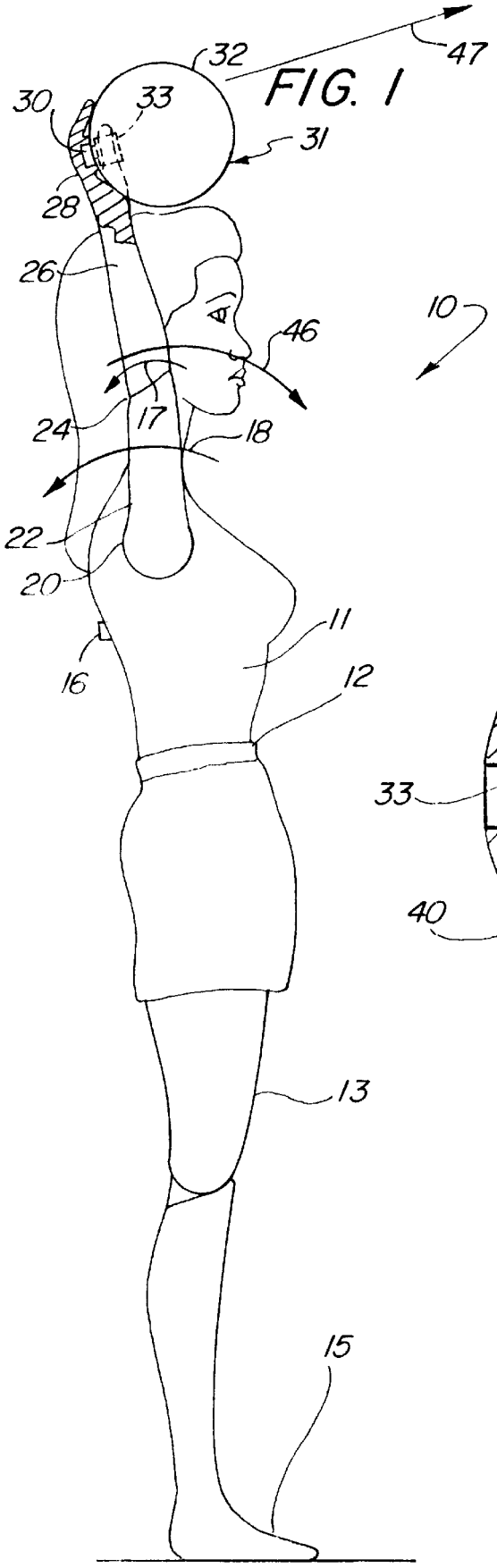
FIG. 1 sets forth a partial section side view of an articulated toy figure constructed in accordance with the present invention together with a cooperating basketball object.
Figure 3:
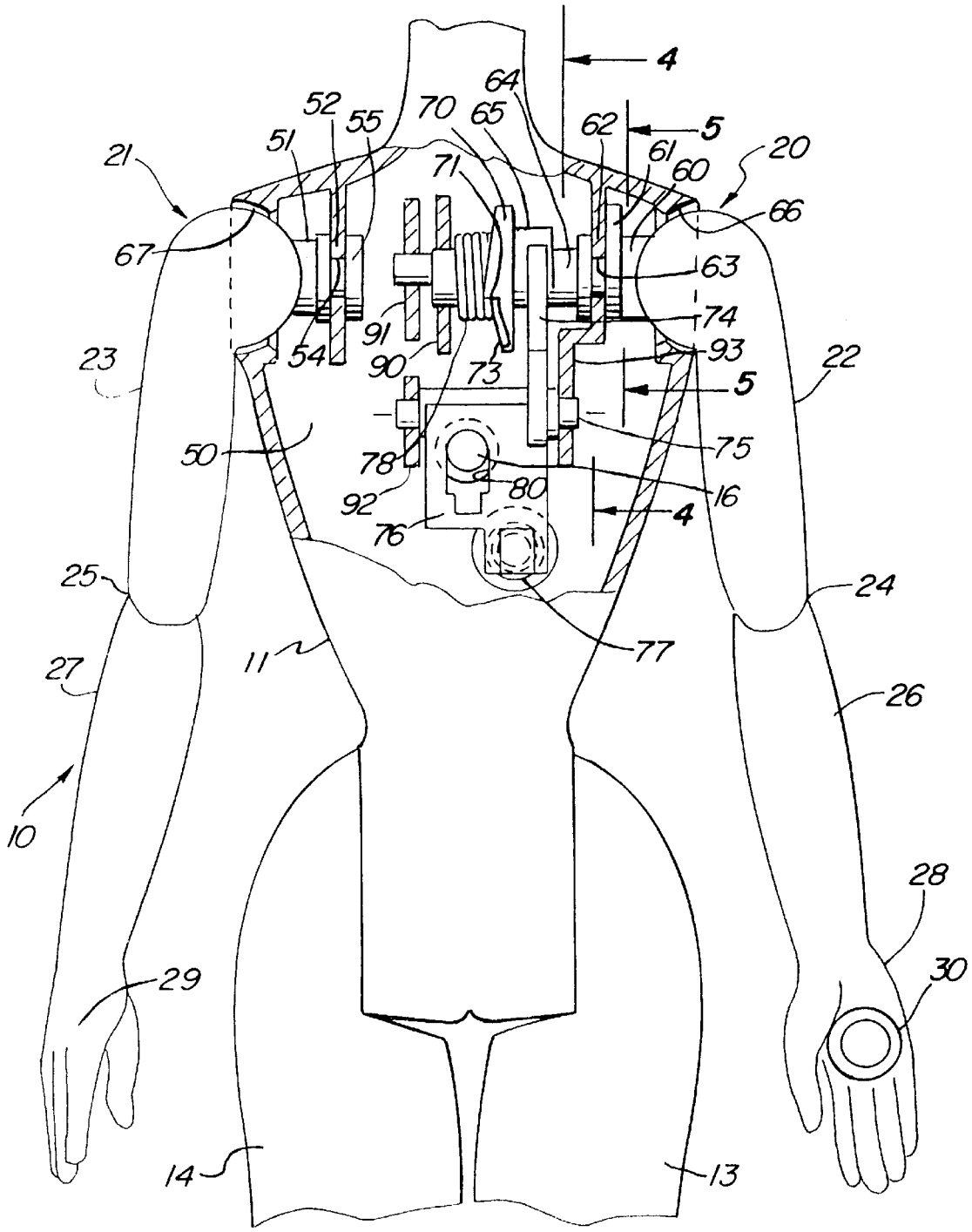
FIG. 3 sets forth a partially sectioned rear view of the torso portion of the present invention articulated toy figure.

FIG. 1 sets forth partially sectioned side elevation view of an articulated toy figure constructed in accordance with the present invention and generally referenced by numeral 10. Toy FIG. 10 is preferably formed of a molded plastic material or the like and is formed to resemble young woman or young girl. However, it will be apparent to those skilled in the art that toy FIG. 10 may, if desired, be fabricated to replicate other appearance figures such as a male human or even fanciful or animal figures without departing from the spirit and scope of the present invention. Toy FIG. 10 includes a torso 11 forming a waist 12 and supporting a right leg 13 and a left leg 14 (left leg 14 shown in FIG. 3). A foot 15 is supported at the lower end of right leg 13 and while not seen in the figures, it will be understood that left leg 14 supports a similar foot at the bottom end thereof. Toy FIG. 10 is shown resting upon a flat surface and is standing substantially erect. Thus, toy FIG. 10 includes a right upper arm 22 secured to torso 11 by a right shoulder joint 20. With reference to FIG. 3, toy FIG. 10 also includes a left upper arm 23 secured to torso 11 by a left shoulder joint 21.

Returning to FIG. 1, in accordance with the present invention, right upper arm 22 is coupled to the internal spring-loaded trigger mechanism set forth in FIGS. 3 through 6. A pivoting elbow joint 24 couples right arm 22 to a right forearm 26 which in turn supports a right hand 28. In further accordance with the present invention, right hand 28 defines a palm portion which supports an attraction element 30. Toy FIG. 10 further includes a trigger button 16 extending rearwardly from the back surface of torso 11.

With temporary reference to FIG. 3, it will be noted that left upper arm 23 is pivotally coupled at an elbow joint 25 to forearm 27 which in turn supports left hand 29.

In further accordance with the present invention, a ball 31 defining a generally spherical outer surface 32 is shown received upon right hand 28 of toy FIG. 10. As is better seen in FIG. 2, ball 31 further supports an attraction element 33. The combination of attraction element 30 of hand 28 and attraction element 33 of ball 31 preferably utilizes a pair of magnetically interactive elements which provide retention of ball 31 against hand 28 through magnetic attraction. However, it will be apparent to those skilled in the art that other forms of releasible attachment may be utilized between ball 31 and hand 28 without departing from the spirit and scope of the present invention. For example, a weak adhesive similar to that used in adhesively posted notepads or the like may be used. The important aspect of the mechanism of attraction elements 30 and 33 is the provision of the releasible coupling which is established by placing ball 31 in proximity to hand 28.

It will also be apparent to those skilled in the art that in the utilization of the preferred magnetic attachment mechanism that several combinations of attraction elements may be used in employing a magnetic retention force. For example, attraction elements 30 and 33 may each be magnets having oppositely positioned poles to provide magnetic attraction. Alternatively, either of attraction elements 30 or 33 may utilize a magnet while the remaining element utilizes a ferromagnetic material such as steel or the like. In the preferred fabrication of the present invention, a safety consideration arises which seeks to prevent child users from having toy FIG. 10 throw objects which are not ball 31 and as a result the preferred fabrication of the present invention utilizes a magnet for element 33 within ball 31 and a simple metal member for attraction element 30. In this manner, the child user cannot place unauthorized metal objects such as paper clips or the like against hand 28 and have them retained for shooting as they would be should a magnet be used in hand 28.

In operation and by means set forth below in greater detail, the user cocks the throwing mechanism of the present invention by rotating upper arm 22 in the direction indicated by arrow 18 to a raised position at which a lock and trigger mechanism (set forth below in FIG. 3) is operative to lock the throwing position of right arm 22. In addition, the pivotal attachment at elbow joint 24 facilitates positioning of hand 28 by pivotal movement of forearm 26 in the manner indicated by arrow 17. Finally with ball 31 magnetically secured to hand 28 in the manner shown, toy FIG. 10 is ready to undertake a basket shooting type throw. The throw is initiated by the user by simply pressing trigger button 16 as the user holds torso 11 to steady toy FIG. 10. Once trigger button 16 has been pressed, the trigger lock mechanism within torso 11 (seen in FIG. 3) is released and the internal spring (spring 78 in FIG. 3) releases stored energy by rapidly pivoting the right arm of toy FIG. 10 in the direction indicated by arrow 46. This rapid forward movement overcomes the magnetic attraction between attraction elements 30 and 33 causing ball 31 to be thrust upwardly and forwardly in a flight path generally indicated by arrow 47. The objective in the basketball game contemplated herein is for toy FIG. 10 to successfully launch ball 31 toward a basket formed in goal 100 (seen in FIG. 7).

To reload toy FIG. 10 and prepare for a follow-up shot, the user simply again pivots right upper arm 22 about shoulder 20 in the direction indicated by arrow 18 until the operative trigger lock mechanism (seen in FIG. 3) latches upper arm 22 in the raised position. Thereafter, the user may again position right forearm 26 by pivoting about elbow joint 24 and again place ball 31 within hand 28.

Figure 2:
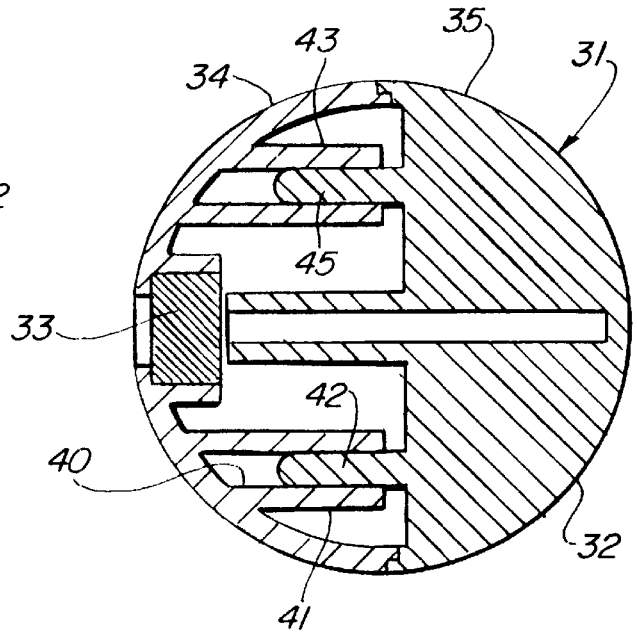
FIG. 2 sets forth a section view of the cooperating basketball of the present invention articulated toy figure.

FIG. 2 sets forth a section view of ball 31 utilizing a magnetic attraction element 33 which comprises a permanent magnet. Ball 31 defines a spherical surface 32 and is formed of hemispherical portions 34 and 35. Portions 34 and 35 are differently fabricated in order to generally balance ball 31 against the substantial weight of attraction element 33. Accordingly, it will be noted that hemisphere 35 is substantially solid plastic material while hemisphere 34 defines substantial open space to reduce the weight therein. In the preferred fabrication of the invention, the solid plastic material of hemisphere 35 generally balances the combined weight of attraction element 33 and hemisphere 34. Thus, hemisphere 35 defines a pair of extending posts 42 and 45 which are received within apertures 40 and 44 respectively of cylindrical bosses 41 and 43. A conventional attachment mechanism such as adhesive attachment or the like may be utilized to secure portions 34 and 35 together.

FIG. 3 sets forth a partially sectioned rear view of toy FIG. 10 which shows the internal arm spring and trigger latch mechanisms of the present invention figure. As described above, toy FIG. 10 is preferably fabricated of a plurality of molded plastic parts which includes a torso portion 11 having a right leg 13 and a left leg 14 secured thereto. Torso 11 further defines an interior cavity 50 and a pair of shoulder sockets 66 and 67. A right upper arm 22 is received within socket 66 and further includes an inwardly extending web 60 joined to a flange 61. Flange 61 and web 60 are further joined to a rotatable shaft 64 which is rotatably supported by an aperture 63 formed in a flange 62 within interior cavity 50. Shaft 64 is further supported by a pair of flanges 90 and 91 having respective apertures formed therein which receive the end portion of shaft 64 and provide a rotational bearing therefor. Shaft 64 further includes a cam 65 having a shape better seen in FIGS. 4 and 6. A spring coupler 70 is further joined to cam 65 and is rotatable therewith. Spring coupler 70 further includes a notch 71 which receives end 73 of a coil spring 78. Spring 78 is wound upon shaft 64 and, as is better seen in FIG. 4, includes a static end 79.

Toy FIG. 10 further includes a lock arm 74 which rides upon cam 65 in the manner shown in FIGS. 4 and 6 and described below. Suffice it to note here that lock arm 74 is capable of engaging cam 65 at some positions of the cam. Lock arm 74 is further joined to an arm pivot 76 which is pivotally supported within interior cavity 50 by a pivot shaft 75. Pivot arm 76 is further coupled to a spring 77 which provides a spring force against pivot arm 76 urging pivot arm 76 toward the rear of torso 11.

Figures 4, 5, 6:
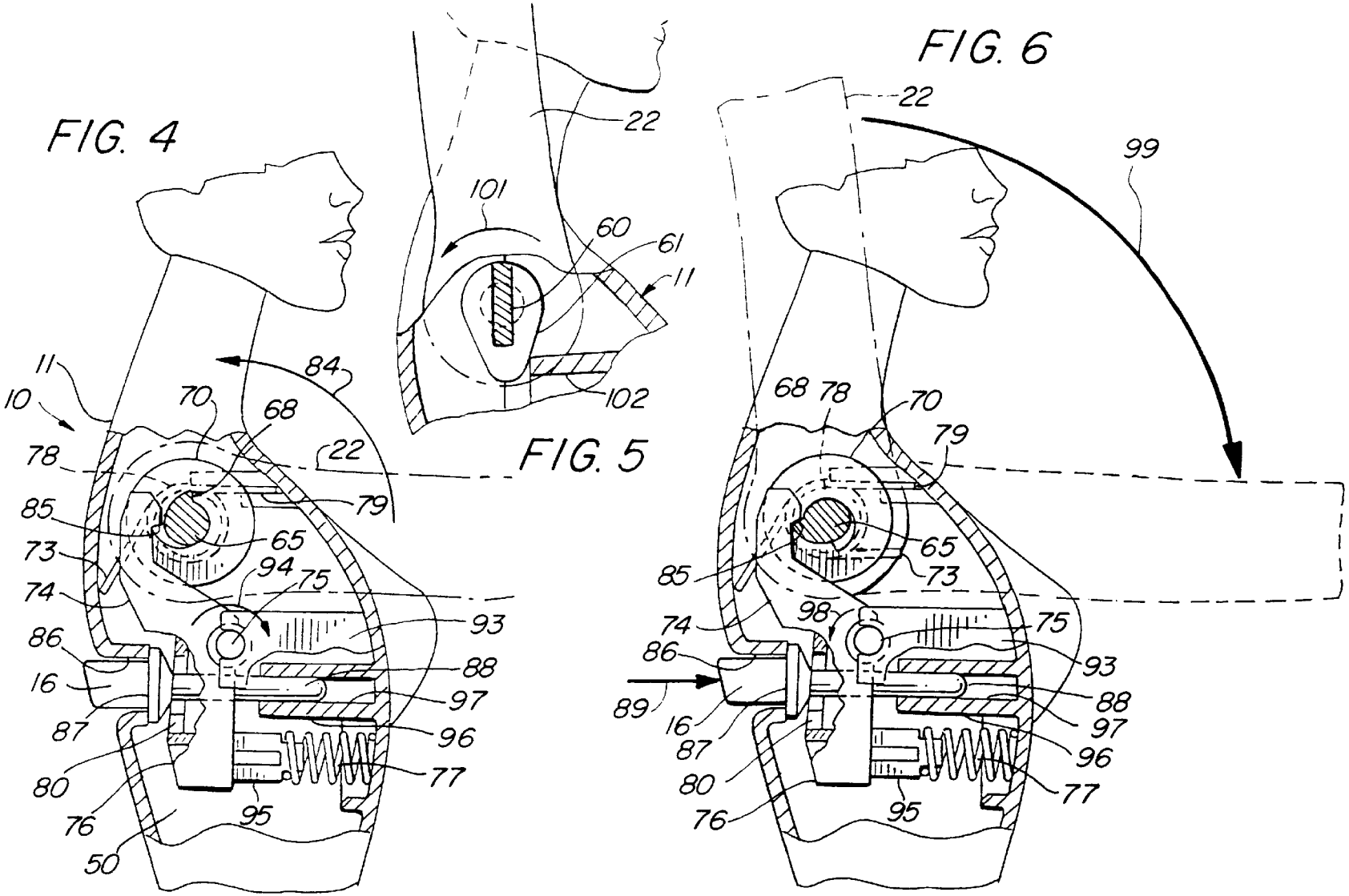
FIG. 4 sets forth a partial section view of the torso portion of the present invention articulated toy figure taken along section lines 4—4 in FIG. 3.
FIG. 5 sets forth a partial section view of the shoulder portion of the present invention articulated toy figure taken along section lines 5—5 in FIG. 3.
FIG. 6 sets forth a partial section view of the torso portion of the present invention articulated toy figure in its arm cocked position.

A pivot button 16 is slidably supported in the rear surface of torso 11 in the manner shown in FIGS. 4 and 6. Trigger button 16 extends inwardly through an elongated aperture 80 formed in arm pivot 76.

Toy FIG. 10 further includes a left upper arm 23 having an elbow 24 joined to a left forearm 27 which in turn supports a left hand 29. Left upper arm 23 is received within socket 67 and includes a shaft 51 captive within an aperture 54 formed in an internal support flange within interior cavity 50. As a result, left shoulder 21 provides pivotal attachment of left upper arm 23.

The operation of the spring-loaded arm and trigger latch of the present invention toy figure is set forth below in FIGS. 4 and 6 in greater detail. However, suffice it to note here that ball 31 (seen in FIG. 1) may be secured to attraction element 30 utilizing the above-described attractions such as adhesive or magnetic. Attraction element 30, it will be recalled, is preferably formed of a metallic disk cooperating with a permanent magnet secured within ball 31. The coupling of upper arm 22 through web 60 and flange 61 to shaft 64 facilitates the pivoting motion of upper arm 22 toward the raised position shown in FIG. 1. During this rotation, the throwing mechanism is moved to its loaded or cocked position. As shaft 64 rotates, energy is stored within spring 78 due to the concurrent rotation of spring coupler 70. Once cam 65 reaches its engagement position with lock arm 74, the force of spring 77 against arm pivot 76 maintains the lock arm to cam engagement and latches arm 22 in the raised and cocked position. Triggering of the basket shooting activity is provided by the cooperation of pivot 75 which pivotally supports the combination of lock arm 74 and arm pivot 76. Because spring 77 urges arm pivot 76 rearwardly, the force applied by trigger button 16 extending forwardly against arm plate 76 overcomes the force of spring 77 and releases the engagement of lock arm 74 to cam 65. Once the latch has been released, spring 78 rapidly rotates shaft 64 and upper arm 22 to provide the basketball shooting action.

FIG. 4 sets forth a partial section side view of toy FIG. 10 taken along section lines 4—4 in FIG. 3. By way of overview, FIG. 4 shows a section view of the arm operating mechanism of the present invention in which upper arm 22 is in its relaxed position. In contrast, FIG. 6 sets forth the operative mechanism within toy 10 when arm 22 has been pivoted upwardly to the full cocked position in preparation to perform the basket shooting activity described above.

More specifically, toy FIG. 10 includes a torso 11 defining an interior cavity 50 within which the operative mechanism of the present invention toy figure is supported. As described above, a cam 65 is supported by a shaft 64 (seen in FIG. 3) which is ultimately joined to an upper arm 22 using the apparatus better seen in FIG. 3. Toy FIG. 10 further includes a spring coupler 70 joined to shaft 64 and cam 65 upon which a coil spring 78 is wound. Spring 78 includes a static end 79 secured within interior cavity 50 and a movable end 73 which as is better seen in FIG. 3 is secured to spring coupler 70. Cam 65 defines a notch 68 and is rotatable along with spring coupler 70 and shaft 64 (seen in FIG. 3).

Toy FIG. 10 further includes a lock arm 74 having a notch 85 formed therein. Lock arm 74 is pivotally supported within interior cavity 50 by a pivot 75 received within a flange 93. Flange 93 is preferably formed integrally with torso 11. Torso 11 further defines a boss 96 having a passage 97 defined therein. Torso 11 also defines a recess 86 on the rear portion thereof within which a button 16 is received. A flange 87 is joined to button 16 and further supports a forwardly extending guide pin 88. An arm pivot 76 joined to lock arm 74 includes a spring post 95 and an aperture 80 formed therein. Guide pin 88 passes through aperture 80 which is sized to freely pass guide pin 88 while preventing flange 87 from passing therethrough. Spring post 95 supports a spring 77 which is captivated against spring post 95 and produces a spring force which urges arm pivot 76 toward a counterclockwise rotation about pivot 75.

In operation, the outward force applied to arm pivot 76 by captive spring 77 against spring post 95 urges lock arm 74 toward pivotal movement about pivot 75 in the direction indicated by arrow 94. This pivotal motion of lock arm 74 forces the upper end of lock arm 74 against the surface of cam 65. Upper arm 22 shown in dashed-line representation extends generally forwardly in a relaxed position in which spring 78 exerts little or no spring force. Arm 22 is moved to the cocked position by pivoting arm 22 upwardly in the direction indicated by arrow 84. This upward pivoting of upper arm 22 produces a corresponding pivoting motion of cam 65, spring coupler 70 and shaft 64 (the latter seen in FIG. 3). As upper arm 22 pivots upwardly, cam 65 is rotated correspondingly until notch 68 of cam 65 is aligned with notch 85 of lock arm 74. Once this alignment is reached, the force spring 77 pivoting lock arm 74 in the direction of arrow 94 locks upper arm 22 in the raised position against the force of spring 78.

FIG. 5 sets forth a partial section view showing upper arm 22 supported upon torso 11. Within torso 11, a stop limit member 102 is positioned within the path of flange 61 supported by web 60 which in turn is coupled to upper arm 22 in the manner described above. The cooperative function of stop 102, flange 61 and web 60 provides a travel limit for the pivotal movement of upper arm 22 during the energy storing and cocking operation in which upper arm 22 is pivoted in the direction indicated by arrow 101. Thus, the operative mechanism of the present invention is protected against excessive force and excessive movement of upper arm 22 when storing energy for a basketball shot.

FIG. 6 sets forth a partial section view of toy FIG. 10 taken along section lines 4—4 in FIG. 3 in which the operative mechanism of the present invention toy figure is moved to its fully cocked position prior to the above-described ball shooting activity.

More specifically, toy FIG. 10 includes a torso 11 defining an interior cavity 50 within which the operative mechanism of the present invention toy figure is supported. As described above, a cam 65 is supported by a shaft 64 (seen in FIG. 3) which is ultimately joined to an upper arm 22 using the apparatus better seen in FIG. 3. Toy FIG. 10 further includes a spring coupler 70 joined to shaft 64 and cam 65 upon which a coil spring 78 is wound. Spring 78 includes a static end 79 secured within interior cavity 50 and a movable end 73 which as is better seen in FIG. 3 is secured to spring coupler 70. Cam 65 defines a notch 68 and is rotatable along with spring coupler 70 and shaft 64 (seen in FIG. 3).

Toy FIG. 10 further includes a lock arm 74 having a notch 85 formed therein. Lock arm 74 is pivotally supported within interior cavity 50 by a pivot 75 received within a flange 93. Flange 93 is preferably formed integrally with torso 11. Torso 11 further defines a boss 96 having a passage 97 defined therein. Torso 11 also defines a recess 86 on the rear portion thereof within which a button 16 is received. A flange 87 is joined to button 16 and further supports a forwardly extending guide pin 88. An arm pivot 76 joined to lock arm 74 includes a spring post 95 and an aperture 80 formed therein. Guide pin 88 passes through aperture 80 which is sized to freely pass guide pin 88 while preventing flange 87 from passing therethrough. Spring post 95 supports a spring 77 which is captivated against spring post 95 and produces a spring force which urges arm pivot 76 toward a counterclockwise rotation about pivot 75.

In operation once upper arm 22 has been pivoted to the raised position shown and cam 65 is locked to lock arm 74 by the engagement of notches 68 and 85 respectively, end 73 of spring 78 has been moved by coupler 70 to the spring-loaded position shown in FIG. 6. With the movement of end 73, substantial energy is stored within spring 78 which urges arm 22 toward pivotal motion in the direction indicated by arrow 99. With cam 65 fully engaging lock arm 74 and spring 77 urging lock arm 74 against cam 65, upper arm 22 is maintained in a raised and locked position against the force of spring 78.

A basket shooting activity is initiated by pressing trigger button 16 inwardly in the direction indicated by arrow 89 which brings flange 87 against arm pivot 76. As mentioned above, aperture 80 of arm pivot 76 is smaller than flange 87. As a result, a force applied to button 16 is communicated by flange 87 against arm pivot 76. This force results in overcoming spring 77 and pivoting the combination of arm pivot 76 and lock arm 74 about pivot 75 in the direction indicated by arrow 98. As lock arm 74 has pivoted away from cam 65, the engagement of notches 68 and 85 is released and the stored energy within spring 78 rapidly rotates cam 65, coupler 70, flange 61, shaft 64 and web 60 (seen in FIG. 3) to provide a high speed pivotal movement of upper arm 22 in the direction indicated by arrow 99. As mentioned above and shown in FIG. 1, the rapid motion of upper arm 22 causes ball 31 to be launched. Arm 22 then comes to a rest position shown in FIG. 4 where after the cycle may be repeated.

Figure 7:
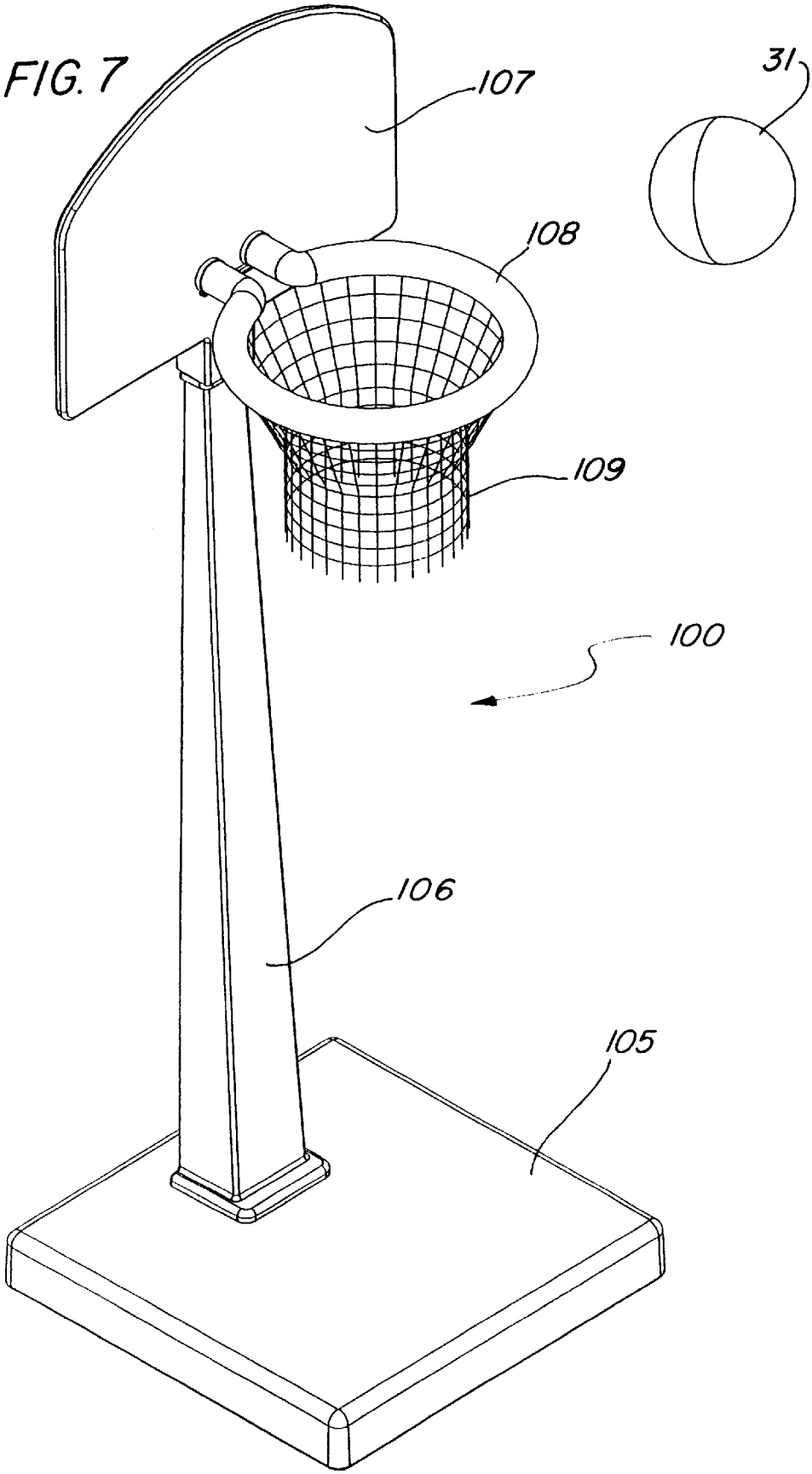
FIG. 7 sets forth a typical basketball goal provided for cooperation with the present invention articulated toy figure.

FIG. 7 sets forth a perspective view of a typical basketball goal suitable for use with the present invention toy figure and generally referenced by numeral 100. It will be understood by those skilled in the art that a variety of differently shaped basketball goals having differing appearances from goal 100 may be utilized without departing from the spirit and scope of the present invention. In its preferred fabrication, goal 100 is fabricated of a plurality of snapped together molded plastic components. Thus, goal 100 includes a generally rectangular base 105 supporting a vertically extending support post 106. A backboard 107 is secured to the upper end of post 106 and supports a basketball hoop 108. A flexible net 109 is secured to hoop 108. For purposes of relative size between hoop 108 and ball 31, ball 31 is shown in the perspective view of FIG. 7.

What has been shown is an articulated toy figure for simulating basketball play in which a spring-loaded and trigger release mechanism is utilized to spring load one arm of the toy figure. A pair of attraction elements such as a pair of elements attracted by magnetic force is supported to provide one element within the ball and the remaining element within the palm of the spring-loaded arm. Through a simple pivotal motion cocking operation, the spring-loaded arm is poised for launching the ball by the simple release of a trigger button.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A toy figure performing a basketball shot, said toy figure comprising:

a torso defining an interior cavity;

an arm pivotally secured to said torso to form a shoulder;

a hand supported by said arm having a first attraction element supported thereby;

a spring-loaded arm mechanism supported within said interior cavity having a shaft rotatably supported by said torso and having one end joined to said arm and having a spring coupler and cam formed thereon together with a spring urging said arm toward a forwardly pivoting movement;

a trigger latch mechanism supported within said interior cavity having a lock arm and arm pivot pivotally supported by said torso, said lock arm and said cam having a cooperating engagement members;

a trigger button supported by said torso for exerting a force against said arm pivot which releases engagement of said lock arm and said cam allowing said spring to rapidly pivot said arm forwardly and downwardly; and a ball having a section attraction element supported thereby, said first and second attraction elements cooperating to releasibly maintain said ball against said hand, whereby said ball placed in said hand when said arm is cocked and released by said trigger button is shot forwardly and upwardly during said forwardly and downwardly pivotal motion of said arm.

2. The toy figure set forth in claim 1 wherein said first and second attraction elements are magnetic attraction.

3. The toy figure set forth in claim 2 wherein said first attraction element is a ferromagnetic metal and said second attraction element is a permanent magnet.

4. The toy figure set forth in claim 2 wherein said first and second attraction elements are permanent magnets.

5. The toy figure set forth in claim 2 wherein said first attraction element is a permanent magnet and said second attraction element is a ferromagnetic metal.

* * * * *